US010823519B1

(12) United States Patent
Paszkiewicz

(10) Patent No.: US 10,823,519 B1
(45) Date of Patent: Nov. 3, 2020

(54) DETACHABLE SELECTOR ASSEMBLY FOR KALASHNIKOV STYLE FIREARMS

(71) Applicant: Thomas Paszkiewicz, Kansas City, MO (US)

(72) Inventor: Thomas Paszkiewicz, Kansas City, MO (US)

( * ) Notice: Subject to any disclaimer, the term of this patent is extended or adjusted under 35 U.S.C. 154(b) by 0 days.

(21) Appl. No.: 16/680,168

(22) Filed: Nov. 11, 2019

(51) Int. Cl.
*F41A 17/46* (2006.01)

(52) U.S. Cl.
CPC ..... *F41A 17/46* (2013.01)

(58) Field of Classification Search
CPC ..... F41A 17/46; F41A 17/52
USPC ..... 42/70.06
See application file for complete search history.

(56) References Cited

U.S. PATENT DOCUMENTS

| | | | | |
|---|---|---|---|---|
| 3,141,254 | A * | 7/1964 | Savioli | F41A 19/09 42/70.06 |
| 5,025,582 | A * | 6/1991 | Mote, Sr. | F41A 17/46 42/70.06 |
| 6,560,909 | B2 * | 5/2003 | Cominolli | F41A 17/46 42/70.05 |
| 8,127,657 | B2 * | 3/2012 | Gorali | F42C 15/42 42/70.04 |
| 2016/0084599 | A1 * | 3/2016 | Alicea, Jr. | F41A 17/46 42/70.06 |
| 2018/0112941 | A1 * | 4/2018 | Toups | F41A 17/22 |

* cited by examiner

*Primary Examiner* — Bret Hayes

(57) ABSTRACT

A selector assembly for a Kalashnikov style firearm, includes a base plate having an upper surface, a lower surface, and a channel configured for engagement with a portion of a pistol grip of the firearm, the base having a flange extending from the lower surface. The selector assembly includes a selector pivotally attached to the flange along an axis and configured for movement about the axis between a safety position to limit operation of a trigger of the firearm and a firing position to allow operation of the trigger of the firearm.

18 Claims, 5 Drawing Sheets

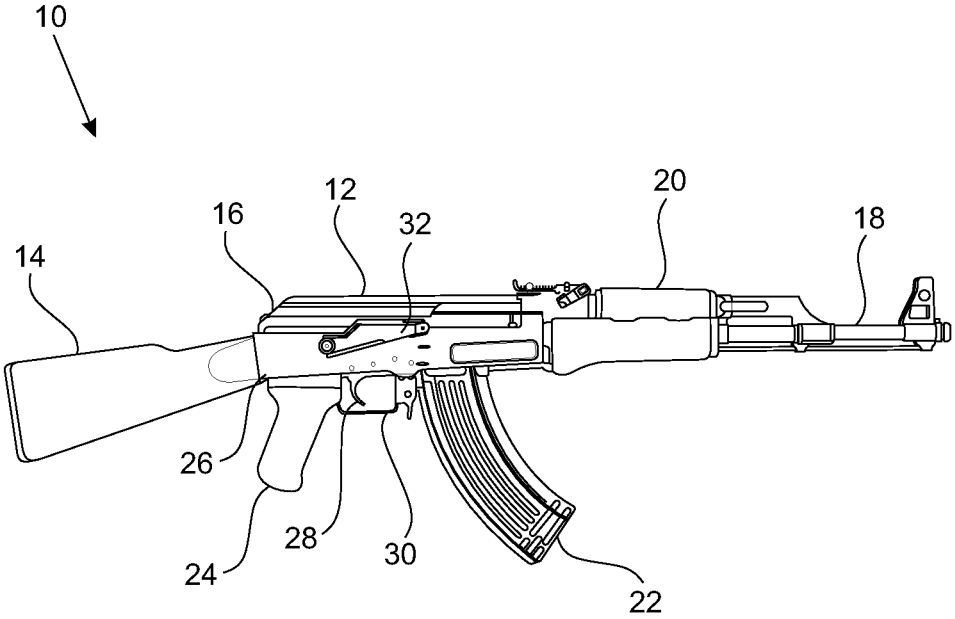
Fig. 1-Prior Art
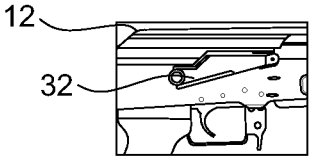
Fig. 2A -Prior Art
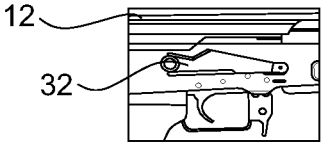
Fig. 2B -Prior Art
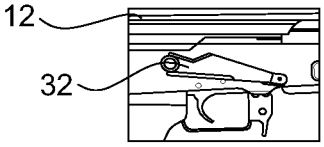
Fig. 2C -Prior Art

DETACHABLE SELECTOR ASSEMBLY FOR KALASHNIKOV STYLE FIREARMS

BACKGROUND OF THE INVENTION

The subject matter herein relates generally to firearms, and more particularly to a selector mechanism for AK-47 Kalashnikov style firearms and variants of AK-47 Kalashnikov style firearms.

After its development in about 1947, the AK-47, or Kalashnikov rifle, and its variants became one of the most common firearms available around the world. The popularity of this firearm stems in part from the simple and reliable design that makes it durable, economical to manufacture, and easy to maintain. Despite these well-known advantages, the AK-47 does have some notable shortcomings.

One of the most recognized drawbacks of the AK-47 is the design of the fire selector. The fire selector is a large lever located on the right side of the rifle, which acts as a dust-cover and pivots between three firing settings: 1) safe (upper position); 2) fully-automatic (center); and 3) semi-automatic (lower position) (FIGS. 2A-2C). In the safe position, the fire selector prevents the charging handle from moving fully to the rear. In operation, an operator typically uses their right fore-fingers to pivot the fire selector between the three settings. The object of this design is to require deliberate action by the operator when selecting a firing setting. For example, under stress an operator may push the selector down with considerable force bypassing the fully-automatic setting and selecting the semi-automatic setting. In contrast, to select the fully-automatic setting requires a more deliberate action of centering the fire selector by the operator. However, to operate the fire selector, right-handed operators must briefly remove their right hand from the pistol grip, which is slow and cumbersome in comparison to other firearms.

There are a large number of Kalashnikov style firearms already in existence around the world that would benefit from an accessory to improve the functionality of the fire selector which easily attaches to the firearm without the need for any modification. Accordingly, there is a need for a detachable accessory for Kalashnikov style firearms that provides for quick selection between firing and non-firing without removing the operators primary hand from the pistol grip.

BRIEF DESCRIPTION OF THE INVENTION

In one embodiment, a selector assembly for a Kalashnikov style firearm is provided that includes a base plate having an upper surface, a lower surface, and a channel configured for engagement with a portion of a pistol grip of the firearm, the base having a flange extending from the lower surface. The selector assembly also includes a selector pivotally attached to the flange along an axis and configured for movement about the axis between a safety position to limit operation of a trigger of the firearm and a firing position to allow operation of the trigger of the firearm.

In another embodiment, a method of operating a Kalashnikov style firearm is provided that includes removably attaching a base plate having an upper surface, a lower surface, and a channel with a portion of a pistol grip of the firearm, the base having a flange extending from the lower surface, and pivoting a selector pivotally attached to the flange along an axis between a safety position to limit operation of a trigger of the firearm and a firing position to allow operation of the trigger of the firearm

BRIEF DESCRIPTION OF THE DRAWINGS

The present inventive subject matter will be better understood from reading the following description of non-limiting embodiments, with reference to the attached drawings, wherein below:

FIG. 1 is a side view of a Kalashnikov style firearm according to an embodiment.

FIG. 2A is an enlarged side view of a firing selector of the Kalashnikov style firearm of FIG. 1 with the firing selector in the safe position according to an embodiment.

FIG. 2B is an enlarged side view of the firing selector of the Kalashnikov style firearm of FIG. 1 with the firing selector in the fully-automatic position according to an embodiment.

FIG. 2C is an enlarged side view of the firing selector of the Kalashnikov style firearm of FIG. 1 with the firing selector in the semi-automatic position according to an embodiment.

Corresponding reference numerals indicate corresponding parts throughout the several figures of the drawings.

DETAILED DESCRIPTION OF THE INVENTION

Figure 3:
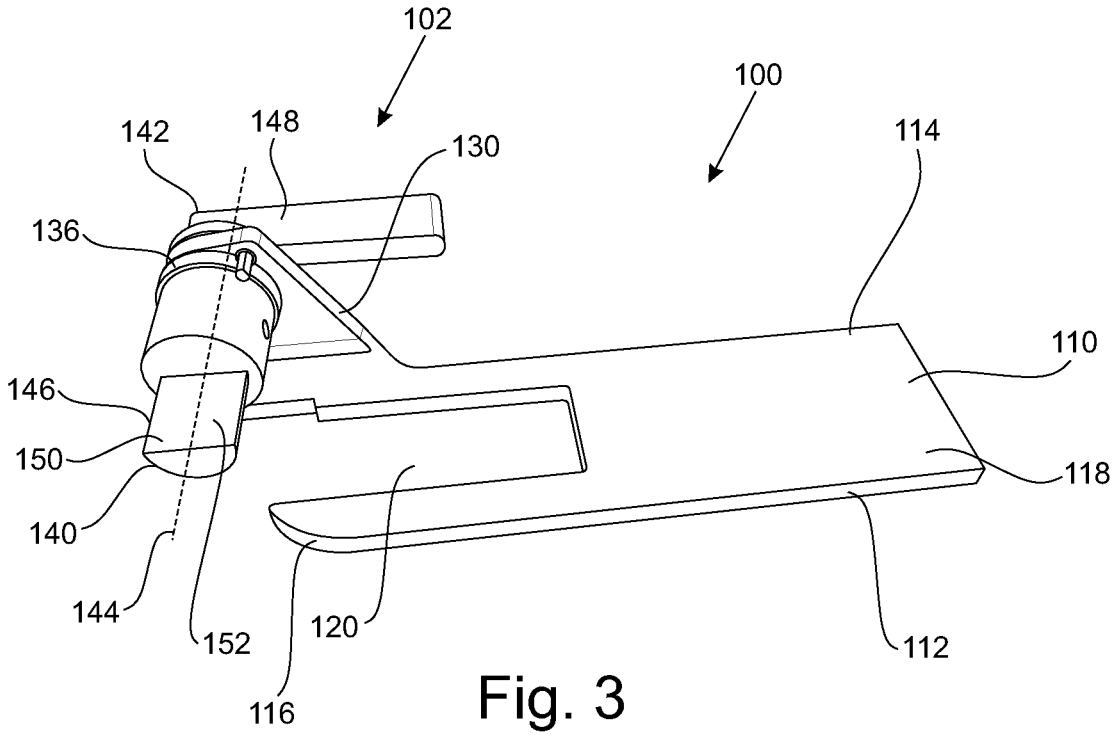
FIG. 3 is a perspective view of a selector assembly according to an embodiment with a selector in a safety position.

The following detailed description illustrates the inventive subject matter by way of example and not by way of limitation. The description enables one of ordinary skill in the art to make and use the inventive subject matter, describes several embodiments of the inventive subject matter, as well as adaptations, variations, alternatives, and uses of the inventive subject matter. Additionally, it is to be understood that the inventive subject matter is not limited in its application to the details of construction and the arrangements of components set forth in the following description or illustrated in the drawings. The inventive subject matter is capable of other embodiments and of being practiced or being carried out in various ways. Also, it is to be understood that the phraseology and terminology used herein is for the purpose of description and should not be regarded as limiting on all embodiments of the inventive subject matter.

FIG. 1 is a perspective view of a Kalashnikov style firearm 10 formed in accordance with one embodiment. In an exemplary embodiment, the firearm 10 includes a receiver 12, a stock 14 extending from a distal end 16 of the receiver 12, a barrel 18 extending from a proximal end 20 of the receiver 12, a magazine 22 detachably engaged with the receiver 12, a pistol grip 24 extending from the a lower portion 26 of the receiver 12, a trigger 28 operatively engaged with a firing mechanism (not shown) within the receiver 12, and a trigger guard 30 generally surrounding the trigger 28. The firearm 10 includes a firing selector 32 operatively engaged with the firing mechanism (not shown) within the receiver 12. In the illustrated embodiment, the firearm 10 is a Kalashnikov style firearm, such as an AK-47. However, the firearm 10 may be another type of firearm in an alternative embodiment. For example, the firearm 10 may define any variant of the AK-47.

FIG. 2A is an enlarged side view of the firing selector 32 of the Kalashnikov style firearm 10 of FIG. 1 with the firing selector 32 in a safe position according to an embodiment. FIG. 2B is an enlarged side view of the firing selector 32 of the Kalashnikov style firearm 10 of FIG. 1 with the firing selector 32 in the fully-automatic position according to an embodiment. FIG. 2C is an enlarged side view of the firing selector 32 of the Kalashnikov style firearm 10 of FIG. 1 with the firing selector 32 in the semi-automatic position according to an embodiment. The firing selector 32 is positioned along a right surface of the receiver 12 and configured to pivot between three operating positions: 1) safe (upper position) (FIG. 2A); 2) full-automatic (center) (FIG. 2B); and 3) semiautomatic (lower position)(FIG. 2C). In operation, an operator typically uses their right forefingers to pivot the fire selector 32 between the three settings. For example, an operator may push the selector down with considerable force bypassing the fully-automatic setting and selecting the semi-automatic setting. Alternatively, the operator may pivot the firing selector 32 to the center position to select the fully-automatic setting.

Figure 4:
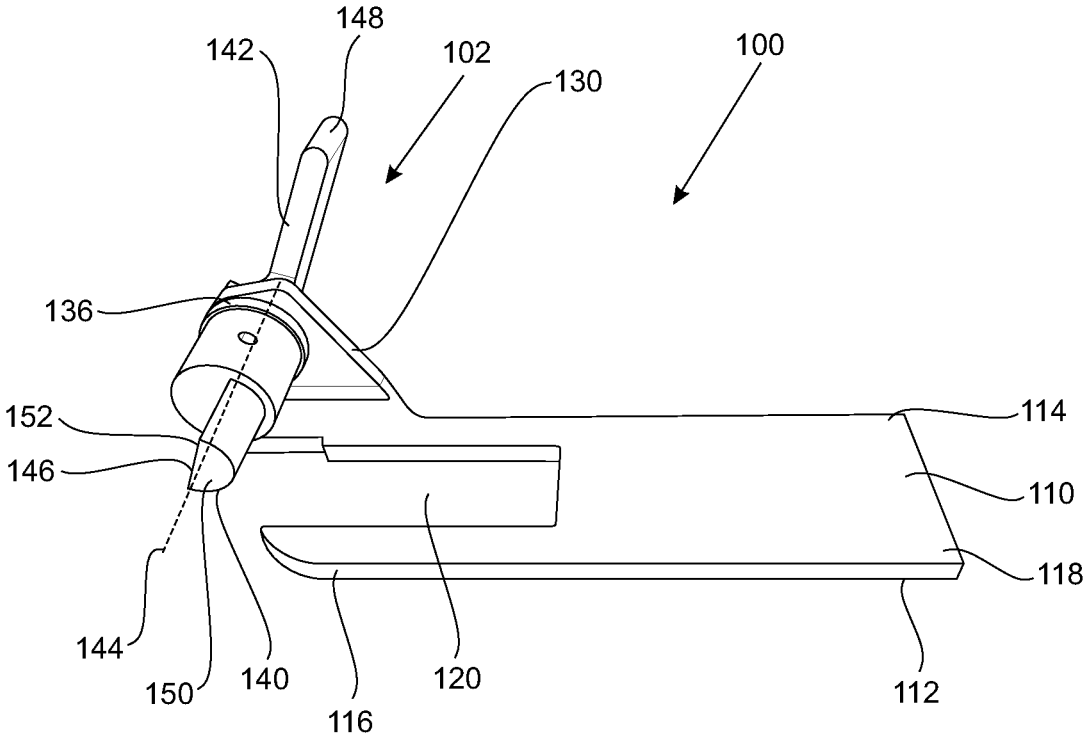
FIG. 4 is a perspective view of the selector assembly according to an embodiment with the selector in a firing position.

FIG. 3 is a perspective view of a selector assembly 100 according to an embodiment with a selector 102 in a safety position. FIG. 4 is a perspective view of the selector assembly 100 according to an embodiment with the selector 102 in a firing position. The selector assembly 100 is configured for detachable engagement with the firearm for operative movement between the safety position (FIG. 3) that limits operation of the trigger 28, and the firing position (FIG. 4) that allows for normal operation of the trigger 28.

Figure 5:
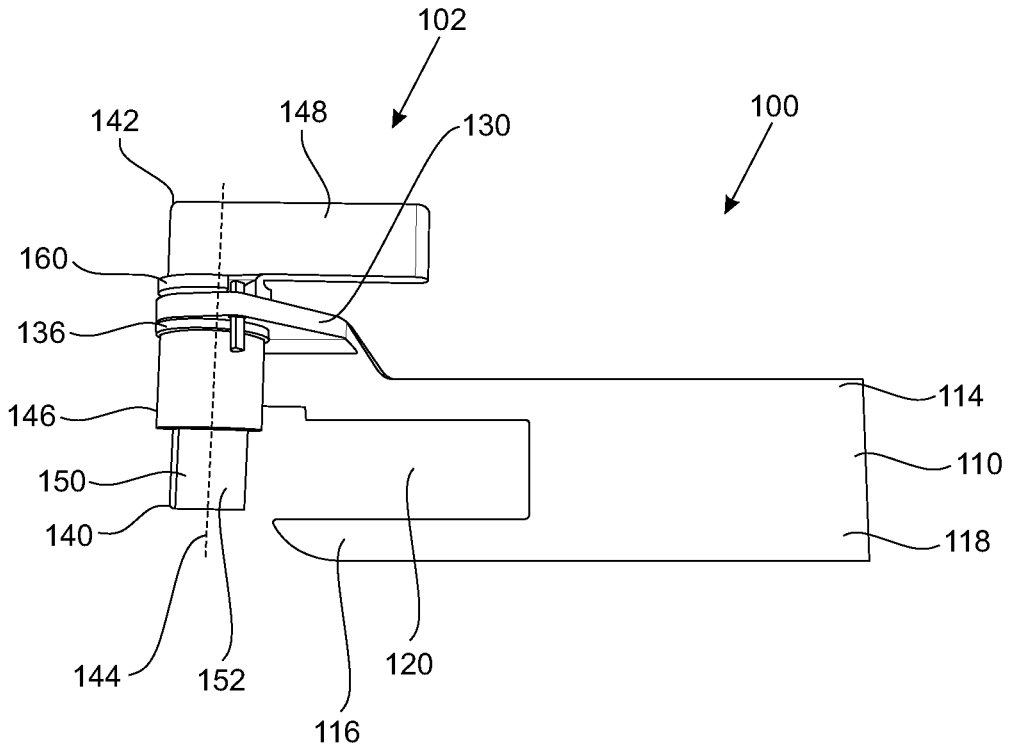
FIG. 5 is a bottom view of the selector assembly according to an embodiment with the selector in the safety position.
Figure 6:
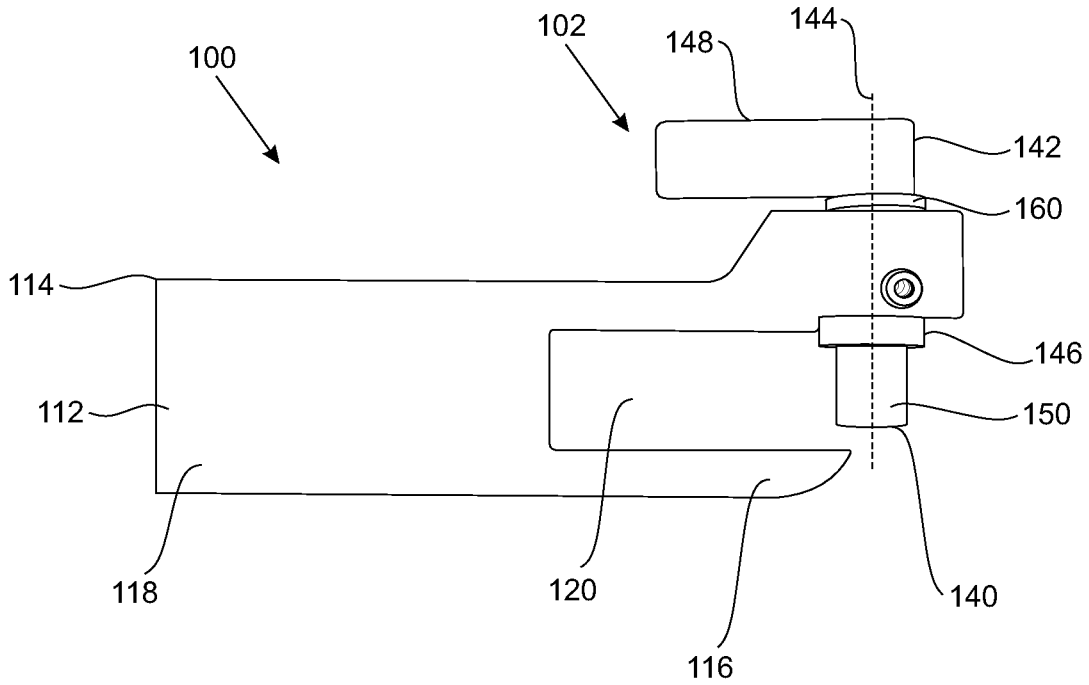
FIG. 6 is a top view of the selector assembly according to an embodiment with the selector in the safety position.
Figure 9:
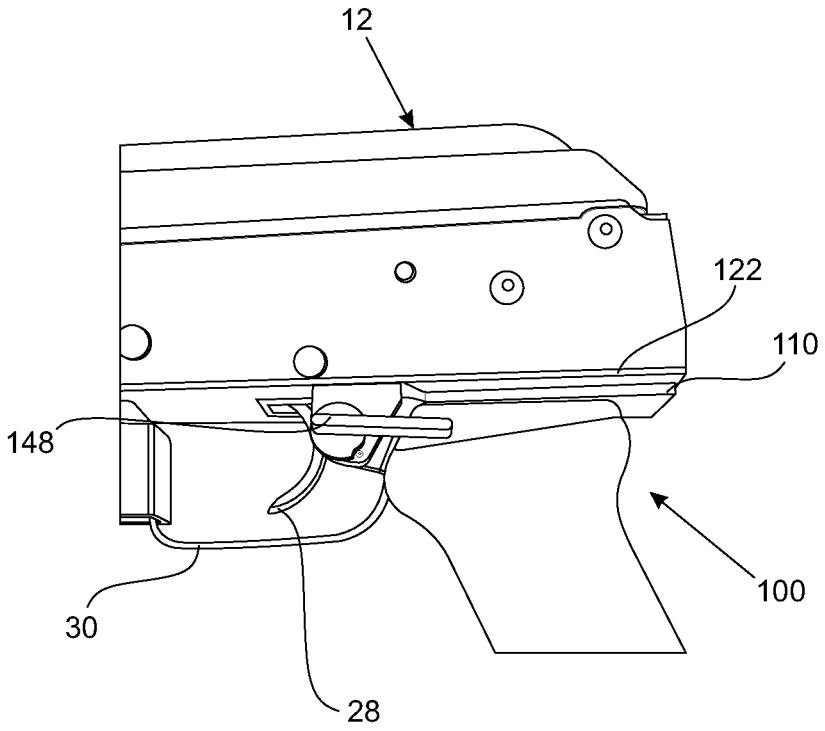
FIG. 9 is an enlarged side view of the selector assembly engaged with the Kalashnikov style firearm according to an embodiment with the selector in the firing position.

FIG. 5 is a bottom view of the selector assembly 100 according to an embodiment with the selector 102 in the safety position. FIG. 6 is a top view of the selector assembly 100 according to an embodiment with the selector 102 in the safety position. The selector assembly 100 includes a generally rectangular base plate 110 having an upper surface 112, a lower surface 114, a distal end 116 and a proximal end 118. The base plate 110 is generally configured to couple with the pistol grip 24 and the receiver 12. For example, the width of the base plate 110 generally corresponds to the width of the receiver 12. In addition, the base plate 110 defines a channel 120 extending longitudinally from the distal end 116 to about the midpoint of the base plate 110. The length and width of the channel 120 generally corresponds to the length and width of the pistol grip 24 at an interface 122, which is located generally adjacent to the lower portion 26 of the receiver 12 (FIG. 9). When the selector assembly 100 is coupled with the firearm 10, the channel 120 receives the pistol grip 24 at an interface 122 and the upper surface 112 of the base plate 110 mates with the lower portion of the receiver 12.

The base plate 110 includes a flange 130 extending generally perpendicular from the lower surface 114 at the distal end 116. The flange 130 includes a bore 132 configured to receive a selector 102. The selector 102 pivotally attaches to the flange 130 through the bore 132. If desired, a bushing or bearing 136 may be disposed between the selector 102 and the flange 130 to provide for smoother movement of the selector 102 and reduction of wear during operation. In the present embodiment, the bushing 136 is a plastic bushing, however, any suitable type of bushing or bearing can be substituted.

The selector 102 includes a distal end 140 and a proximal end 142 positioned along a central axis 144 of the bore 132. The axis 144 is generally perpendicular to the longitudinal axis of the base plate 110, positioned proximate to the distal end 116 of the base plate 110, and positioned below the lower surface 114 of the base plate 110. When the selector assembly 100 is coupled with the firearm 10, the selector 102 is positioned along the axis 144 so that the selector 102 corresponds an operative location behind the trigger 28 (FIG. 9).

Figure 10:
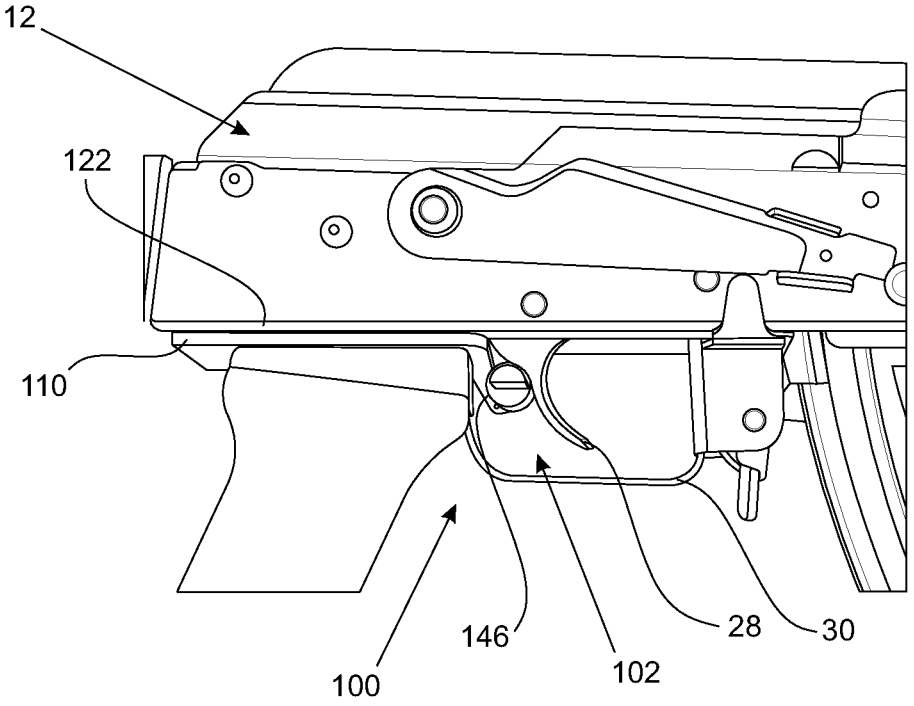
FIG. 10 is an enlarged side view of the selector assembly engaged with the Kalashnikov style firearm according to an embodiment with the selector in the safety position.

The selector 102 includes a trigger mechanism 146 positioned at the distal end 140 and an engagement member 148 at the proximal end 142. The trigger mechanism 146 is configured for operative engagement with the trigger 28 when the selector 102 is positioned in the safety position and for disengagement of the trigger 28 when the selector 102 is in the firing position. For example, the trigger mechanism 146 may include a semi-cylindrical portion 150 extending along the axis 144 of the selector 102, the semi-cylindrical portion 150 having a contact surface 152 configured for operative engagement with the trigger 28 when the selector is positioned in the safety position. (FIG. 10). In the firing position, the semi-cylindrical portion 150 and contact surface 152 are pivoted out of the travel path of the trigger 28 so that the trigger can operate normally.

Figure 7:
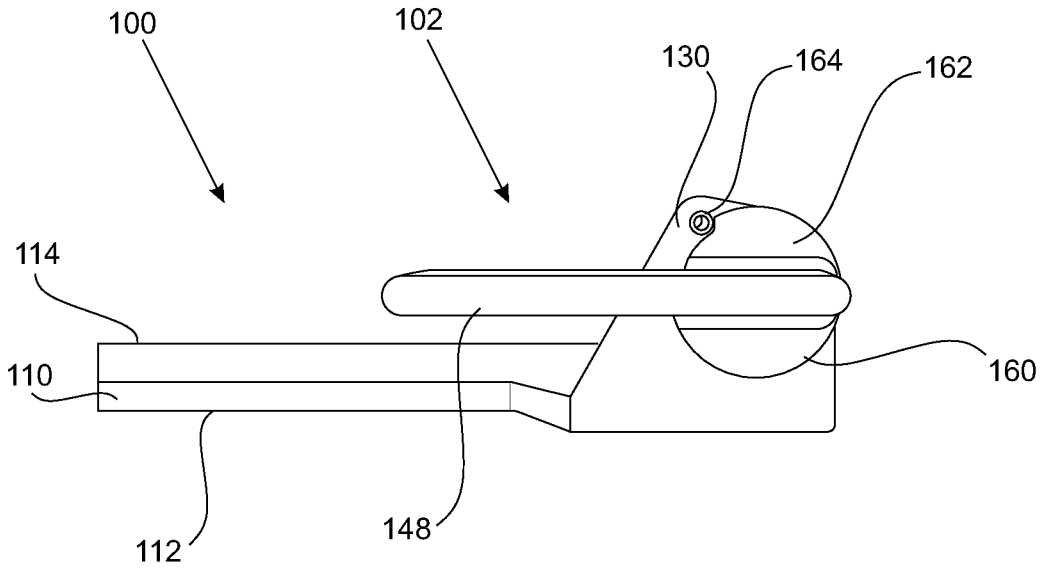
FIG. 7 is an enlarged side view of the selector assembly according to an embodiment with the selector in the safety position.
Figure 8:
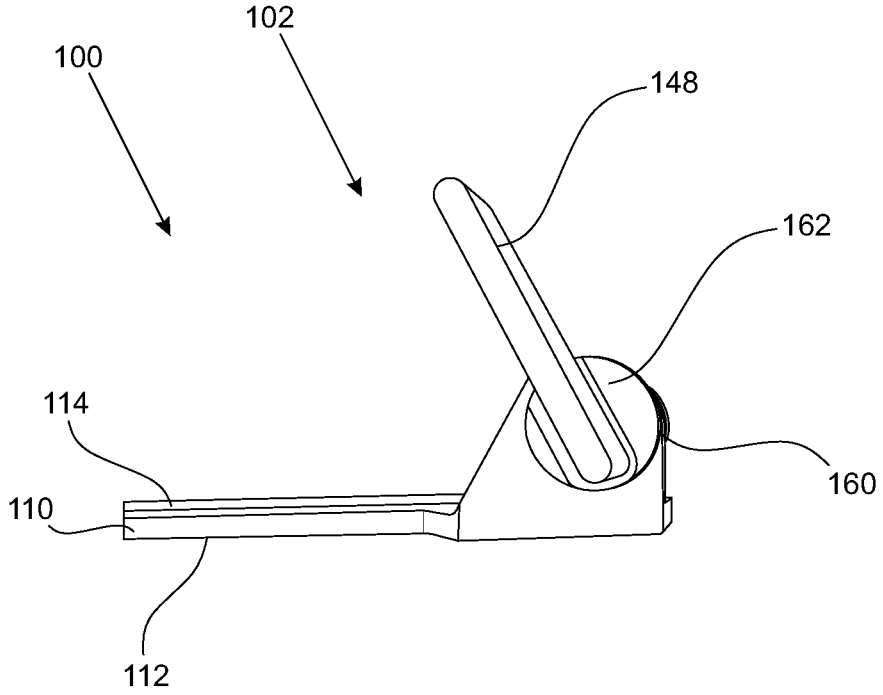
FIG. 8 is an enlarged side view of the selector assembly according to an embodiment with the selector in the firing position.

FIG. 7 is an enlarged side view of the selector assembly 100 according to an embodiment with the selector 102 in the safety position. FIG. 8 is an enlarged side view of the selector assembly 100 according to an embodiment with the selector 102 in the firing position. The selector 102 includes an engagement member 148 configured for operative engagement by an operator for rotation of the selector 102 between the safety position and the firing position. For example, the engagement member 148 may be a lever configured for engagement by an operator's finger or thumb without having to remove their primary hand from the pistol grip. However, the engagement member 148 may be any suitable device, such as a knob, grip, handle, or the like.

The selector 102 includes a cam 160 configured for guiding the rotation of the selector 102 between the safety position and the firing position. For example, the cam 160 may be positioned about the circumference of the base of the engagement member 148 and include a track segment 162 that extends about 45° to about 90°. However, the track segment 162 may extend any suitable length about the circumference. In the present embodiment, the track segment 162 is a generally arcuate recessed portion, however, any suitable geometry can be used. A cam follower 164 extends from the flange 130 for operative engagement with a track segment 162 of the cam 160, which operatively corresponds the range of pivoting of the selector 102 to the length of the track segment 162.

FIG. 9 is an enlarged side view of the selector assembly 100 engaged with the Kalashnikov style firearm 10 according to an embodiment with the selector 102 in the firing position. FIG. 10 is an enlarged side view of the selector assembly 100 engaged with the Kalashnikov style firearm 10 according to an embodiment with the selector 102 in the safety position. The selector assembly 100 engages with the firearm 10 so that the channel 120 receives the pistol grip 24 along an interface plane 122 and the upper surface 112 of the base plate 110 mates (or is at least adjacent) with the lower portion of the receiver 12. In the safety position, the selector is positioned along the axis 144 so that the selector corresponds with the operative location behind the trigger 28. For example, the contact surface 152 contacts the trigger. In the firing position, the semi-cylindrical portion 150 and contact surface 152 are pivoted out of the travel path of the trigger 28 so that the trigger can operate along its normal travel path.

In one or more embodiments, one or more of the components of the selector assembly 100 may be manufactured from any suitable material, including, but not limited to, polymers, metals, metal alloys, any combination thereof.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A selector assembly for a Kalashnikov style firearm, comprising:

a base plate having an upper surface, a lower surface, and a channel configured for engagement with a portion of a pistol grip of the firearm, the base having a flange extending from the lower surface;

a selector pivotally attached to the flange along an axis and configured for movement about the axis between a safety position to limit operation of a trigger of the firearm and a firing position to allow operation of the trigger of the firearm; and a cam configured for guiding the movement of the selector, the selector having a track segment;

a cam follower extending from the flange for operative engagement with a track segment of the cam.

2. The selector assembly of claim 1, the selector further comprising:

a trigger mechanism at a distal end of the selector configured for operative engagement with the trigger when the selector is positioned in the safety position and for disengagement of the trigger when the selector is in the firing position; and an engagement member at a proximal end of the selector configured for operative engagement by an operator for rotation of the selector between the safety position and the firing position.

3. The selector assembly of claim 2, wherein the trigger mechanism includes a semi-cylindrical portion, the semi-cylindrical portion having a contact surface configured for operative engagement with the trigger when the selector is positioned in the safety position.

4. The selector assembly of claim 2, wherein the engagement member is a generally rectangular-shaped lever.

5. The selector assembly of claim 1, the track segment extending about the outer circumference of the cam in a range of about 45°-90°.

6. The selector assembly of claim 1, the track segment being a generally arcuate recessed portion.

7. The selector assembly of claim 1, further comprising a bearing disposed between the selector and the flange.

8. The selector assembly of claim 1, wherein the selector is positioned proximate to the distal end of the base plate and positioned below the lower surface of the base plate.

9. The selector assembly of claim 1, wherein the configuration of the channel corresponds with the length and width of the pistol grip at an interface.

10. A method of operating a Kalashnikov style firearm, comprising:

removably attaching a base plate having an upper surface, a lower surface, and a channel with a portion of a pistol grip of the firearm, the base having a flange extending from the lower surface;

pivoting a selector pivotally attached to the flange along an axis between a safety position to limit operation of a trigger of the firearm and a firing position to allow operation of the trigger of the firearm; and the selector having a cam configured for guiding the movement of the selector, the selector having a track segment, and a cam follower extending from the flange for operative engagement with a track segment of the cam.

11. The selector assembly of claim 10, the selector further comprising:

a trigger mechanism at a distal end of the selector configured for operative engagement with the trigger when the selector is positioned in the safety position and for disengagement of the trigger when the selector is in the firing position; and an engagement member at a proximal end of the selector configured for operative engagement by an operator for rotation of the selector between the safety position and the firing position.

12. The method of claim 11, wherein the trigger mechanism includes a semi-cylindrical portion, the semi-cylindrical portion having a contact surface configured for operative engagement with the trigger when the selector is positioned in the safety position.

13. The method of claim 11, wherein the engagement member is a generally rectangular-shaped lever.

14. The method of claim 10, wherein the track segment extends about the outer circumference of the cam in a range of about 45°-90°.

15. The method of claim 1, wherein the track segment is a generally arcuate recessed portion.

16. The method of claim 10, further comprising a bearing disposed between the selector and the flange.

17. The method of claim 10, wherein the selector is positioned proximate to the distal end of the base plate and positioned below the lower surface of the base plate.

18. The method of claim 10, wherein the configuration of the channel corresponds with the length and width of the pistol grip at an interface.

* * * * *